United States Patent [19]

Weiss

[11] Patent Number: 4,890,844

[45] Date of Patent: Jan. 2, 1990

[54] EDUCATIONAL BOARD GAME

[76] Inventor: Adrienne J. Weiss, 707 Pine Valley Dr., Pittsburgh, Pa. 15239

[21] Appl. No.: 181,501

[22] Filed: Apr. 14, 1988

[51] Int. Cl.[4] ..... A63F 3/00

[52] U.S. Cl. ..... 273/249

[58] Field of Search ..... 273/249, 272, 308, 300, 273/296, 299

[56] References Cited

U.S. PATENT DOCUMENTS

| | | | |
|---|---|---|---|
| 1,635,734 | 7/1927 | Ziegler | 273/249 |
| 2,717,156 | 9/1955 | Nelson | 273/248 |
| 3,939,578 | 2/1976 | Coffey | 273/243 |
| 4,078,803 | 3/1978 | Te | 273/248 |
| 4,090,717 | 5/1978 | Rossetti | 273/249 |
| 4,121,823 | 10/1978 | McBride | 273/243 |
| 4,124,214 | 11/1978 | Pavis | 273/249 |
| 4,273,337 | 6/1981 | Carrera et al. | 273/243 |
| 4,323,249 | 4/1982 | Brady | 273/249 |
| 4,487,418 | 12/1984 | Allen | 273/242 |
| 4,592,553 | 6/1986 | Mammen et al. | 273/240 |
| 4,606,546 | 8/1986 | Rita | 273/269 |
| 4,671,516 | 6/1987 | Lizzola et al. | 273/299 |

FOREIGN PATENT DOCUMENTS

| | | | |
|---|---|---|---|
| 2187968 | 9/1987 | United Kingdom | 273/242 |

OTHER PUBLICATIONS

Game Magazine Article, "In One Era" by David Greenwald, Jan.–Feb. 1981, pp. 14–15, 68.

*Every Cliche in the Book* by Peggy Rosenthal & George Dardess, William Morrow & Company, Inc. N.Y., N.Y., Copyright 1987.

*A Dictionary of American Idioms* by Maxine T. Boatner and John E. Gates, Barron's Educational Series, Inc., Copyright 1975.

"It's a Bird, It's a Bus . . . It's Pictionary", *Newsweek,* Feb. 22, 1988.

*Primary Examiner*—Edward M. Coven

*Assistant Examiner*—Benjamin Layno

*Attorney, Agent, or Firm*—Buchanan Ingersoll Professional Corp.

[57] ABSTRACT

A game for stimulating a plurality of participants to improve language skills and learning to interpret the meaning of figurative expressions includes a game board having a playing field defined by a course extending in a continuous path from a start to a finish. The path is divided into increments and a plurality of game pieces are used by the participants to advance from the start to the finish. A deck of cards is provided and includes on one face of the card a figurative expression, the definition of the figurative expression, and a number designating an increment of advancement on the game board. Appearing on the opposite face of the card is an illustration of the figurative expression. An answering participant is required to interpret from a view of the illustration the corresponding figurative expression, as well as a definition of the expression. Correctly recognizing the figurative expression from the illustration and defining the figurative expression permits the player to advance incrementally the designated number of spaces for each turn on the board. The winner of the game is the first player to advance the full incremental distance from the start to the finish.

13 Claims, 2 Drawing Sheets

EDUCATIONAL BOARD GAME

BACKGROUND OF THE INVENTION

1. Field of the Invention

This invention relates to an educational board game and more particularly to a board game that is intended to teach and familiarize people of all ages the meaning of figurative expressions commonly used in the English language.

2. Description of the Prior Art

Educational board games are well known in the prior art and in particular board games which test the analytical and interpretive skills of the participants. While the board games are intended to provide the participants with amusement and leisure time activity, the subject matter of the games provides the participants with an exercise of learning skills and the opportunity to increase the knowledge of the participants in a particular field or activity. Examples of such board games are disclosed in U.S. Pats. Nos. 3,939,578; 4,078,803; 4,090,717; 4,124,214; 4,273,3377; 4,592,553; 4,606,546; and 4,671,516.

Commercially successful board games which have acquired popularity, not only for their entertainment value but for intellectual stimulation, are marketed under the trademarks "Trivial Pursuit", "Pictionary" and "Whatzit". For example, in the game "Whatzit", the rate of progress of the participants along a continuous path from a start point to a finish point is determined by the individual participant's ability to correctly analyze words on one face of a card to provide an answer in the form of a title or related expression. For example, on the face of one card is the word "rebellion" positioned above the word "reward". The answering participant must analyze these two words and their relative positions to each other and provide an answer which relates to the words. In this case the correct answer is "Mutiny On The Bounty". In the game of "Pictionary" an answering participant must deduce from an illustration drawn by another participant the combination of terms or expressions literally represented by the illustration.

There are many expressions in the English language that, if taken literally, would have a nonsensical meaning but are understood to have a useful figurative meaning. For example, the expression "shake a leg" when used in the English language is commonly known to have a meaning which differs from the literal meaning of the expression, namely, to move quickly about one's business. The English language includes hundreds and hundreds of such figurative expressions that if taken literally have a nonsensical meaning. These expressions have been readily adopted into the English language and, while they are considered to be idiomatic expressions they are used generally in a creative and clever manner. They have been integrated into general English language usage but their meaning may be unfamiliar to some people, such as children and individuals, who are not fluent in the English language.

Therefore, there is need for a game that exposes participants to figurative expressions and stimulates the participants to learn the meaning of these expressions in a manner that is both entertaining in an interactive atmosphere and individually stimulating to the intellect of the participants.

SUMMARY OF THE INVENTION

In accordance with the present invention there is provided a game for stimulating a plurality of participants to improve language skills in learning to interpret figurative expressions that includes a game board having a playing field defined by a course extending in a continuous path from a start point to a finish point. The continuous path is divided into increments from the start point to the finish point. A plurality of game pieces are provided and represent the respective positions of the participants on the course between the start and finish points. A deck of cards is provided. Each card in the deck has on one face thereof a figurative expression, a definition of the figurative expression, as commonly understood in the language, and a number for determining incremental advancement of the respective game pieces along the continuous path. Each of the cards has a different figurative expression thereon. Each card has on an opposite face an illustration being symbolic of the figurative expression. The card face bearing the illustration is revealed to the answering participant for interpreting the illustration with the card face bearing the figurative expression being concealed from the answering participant. The game piece of the answering participant is advanced a selected increment along the path upon the answering participant correctly both identifying the figurative expression and defining the meaning of the figurative expression as interpreted from the illustration on the card face. The game piece of each of the participants is progressively advanced along the path in response to correctly defining the meaning of the figurative expressions until one of the participants is the first to reach the finish point.

Further in accordance with the present invention there is provided a method for playing a game that includes the steps of distributing to each participant a game piece for progressive incremental advancement along a course from a start point to a finish point on a game board. A plurality of cards are arranged in a deck with each card having written on one face a figurative expression and a number for determining incremental advancement along the course. Each participant is allowed in turn to draw an individual card from the deck for providing an answer. The face of the card bearing the figurative expression is concealed from the answering participant and the opposite face of the card having an illustration symbolic of the figurative expression is exposed to the answering participant. The answering participant is required to interpret the illustration on the opposite face of the card and give as an answer the figurative expression corresponding to the illustration. The answer given by the answering participant is compared with the expression written on the one face of the card. The answering participant is rewarded upon giving a correct answer by movement of the game piece of the answering participant a selected incremental advancement along the course. The first participant to incrementally advance along the course from the start point to the finish point as a result of giving correct answers is designated as the winner of the game.

Additionally, in accordance with the present invention, there is provided a method for playing a game for teaching participants the meaning of figurative expressions that includes the steps of distributing to each participant a game piece for progressive incremental advancement along a course from a start point to a finish point on a game board. A plurality of cards are arranged in a deck with each card having written on one face a figurative expression, a definition of the figurative expression as understood in the language, and a number for determining incremental advancement along the course. Each participant is allowed in turn to draw an individual card from the deck for providing an answer. The face of the card bearing the figurative expression is concealed from the answering participant and the opposite face of the card having an illustration symbolic of the figurative expression is exposed to the answering participant. The figurative expression is read to the answering participant as the answering participant views the illustration. The answering participant is required to define the meaning of the figurative expression based on the corresponding illustration. The answer given by the answering participant is compared with the definition of the figurative expression stated on the face of the card. The answering participant is rewarded upon giving a correct answer by movement of the game piece of the answering participant a selected incremental advancement along the course. The first participant to incrementally advance along the course from the start point to the finish point as a result of giving correct answers is designated as the winner of the game.

Accordingly, the principal object of the present invention is to provide a board game for testing the skill of the game participants to identify and define figurative expressions based on illustrations thereof.

Another object of the present invention is to provide a board game that teaches the individual participants the meaning of figurative expressions by requiring an exercise of interpretive skill in recognizing a figurative expression from a symbolic illustration thereof.

Another object of the present invention is to provide a game for both adults and children that is entertaining and intellectually stimulating.

An additional object of the present invention is to provide a game by which individuals studying the English language can become familiar with commonly used expressions that have a figurative meaning which differs from a literal meaning of the expression.

These and other objects of the present invention will be more completely disclosed and described in the following specification, the accompanying drawings, and the appended claims.

DESCRIPTION OF THE PREFERRED EMBODIMENTS

Figure 1:
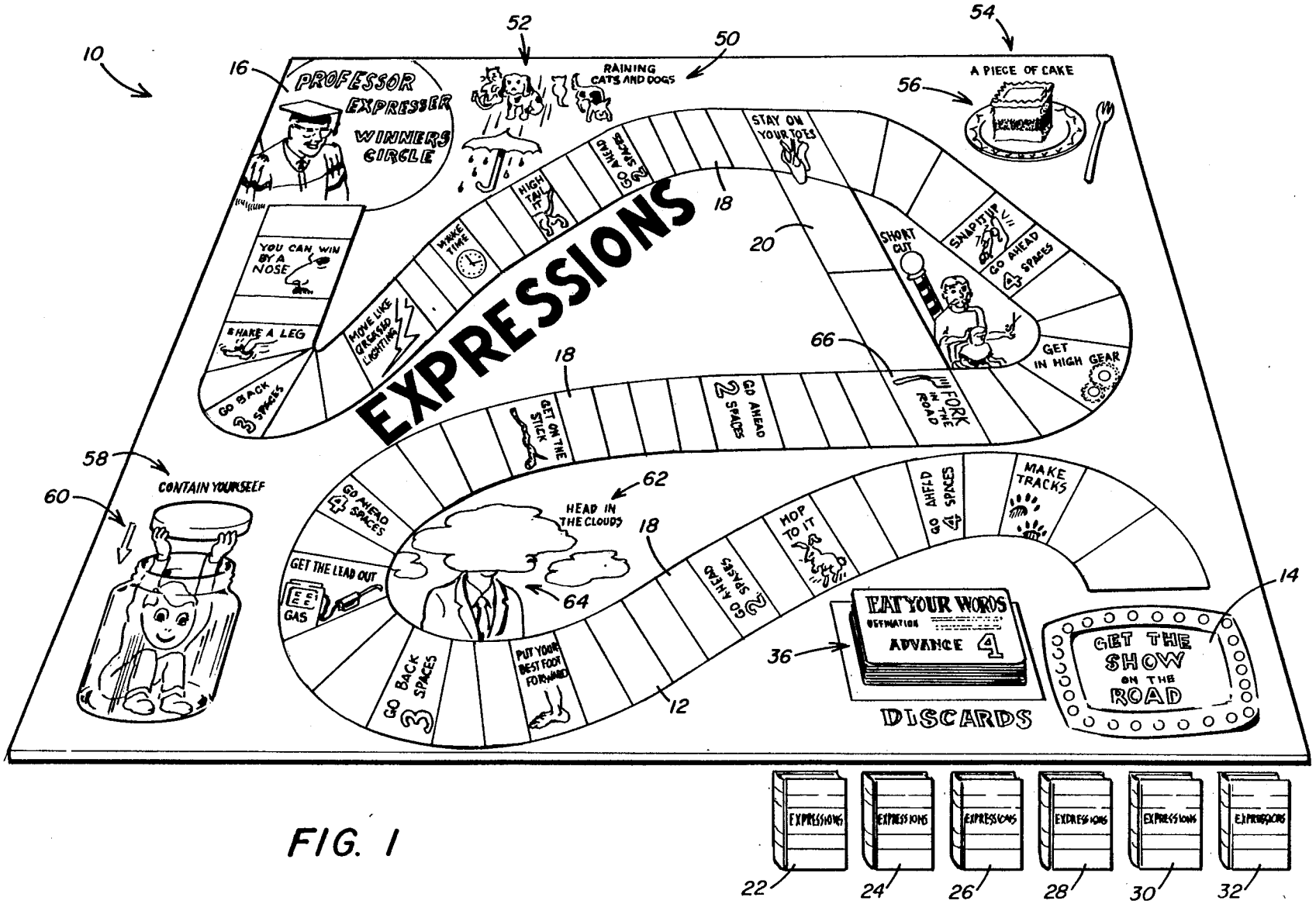
FIG. 1 is a perspective view of a game board in accordance with the present invention.

Referring to the drawings and particularly to FIG. 1, there is illustrated a game board generally designated by the numeral 10 for playing a game entitled "EXPRESSIONS" in accordance with the present invention. The game board 10 has a playing field that is defined by a course which extends in a continuous path from a start point 14 to a finish point or winner's circle 16. The continuous path 12 is divided into a plurality of individual increments 18 that extend from the start point 14 to the finish point 16. At various points along the continuous path 12 are designated increments 18 which facilitate accelerating the progress of the players or regressing the progress of the players. The progress along the path 12 can be shortened by advancement on the short cut 20 which will be described later in greater detail.

At least two participants are required to play the game and preferably up to six individual participants or six teams of participants can enjoyably play the game. Each participant or team of participants is provided with a designated one of playing pieces 22–32 as determined by the number of participants or teams of participants. The game pieces 22–32 are appropriately distinguished from one another by color and may take any selected form as shown in FIG. 1. The game pieces 22–32 are symbolic of a dictionary with the term "EXPRESSIONS" inscribed on each game piece. A plurality of individual playing cards 34 are randomly arranged such as a stack or deck generally designated by the numeral 36 in FIG. 1. Preferably the entire deck 36 of playing cards 34 is conveniently contained in a deck holder constructed to facilitate drawing individual cards from the stack. The card holder is not shown but suitable card holders capable of being used with the present invention are well known in the art.

Figure 2:
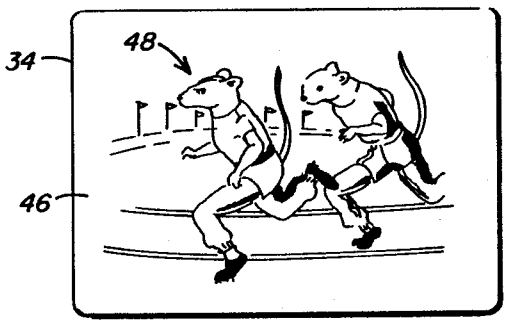
FIG. 2 is a plan view of a face of a representative playing card for the game of the present invention, illustrating a figurative expression.
Figure 2A:
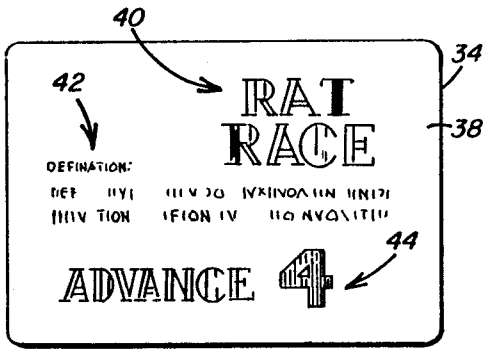
FIG. 2A is a plan view of the opposite face of the card shown in FIG. 2 having the figurative expression, the definition of the figurative expression illustrated on the opposite face of the card shown in FIG. 2, and the number for incremental advancement of the game piece on the board.
Figure 3:
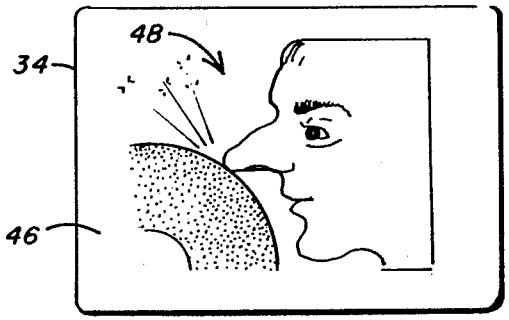
FIG. 3 is a view similar to FIG. 2 of another representative figurative expression in accordance with the present invention.
Figure 3A:
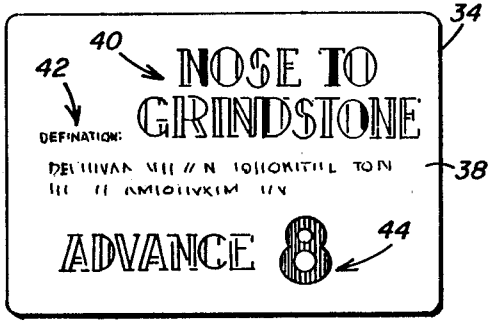
FIG. 3A is a view of the opposite face of the card shown in FIG. 3, having the figurative expression, corresponding definition, and advancement number.
Figure 4:
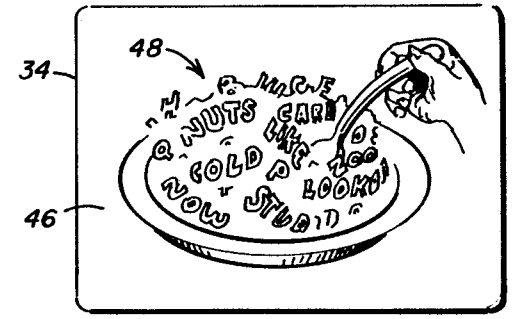
FIG. 4 is an additional view similar to FIGS. 2 and 3 of another figurative expression.
Figure 4A:
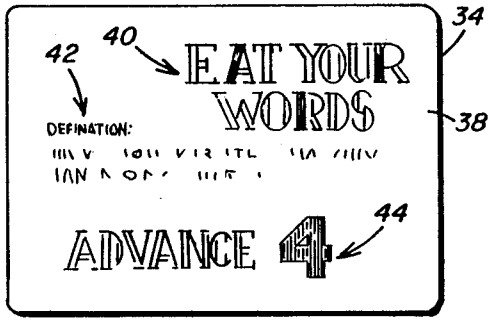
FIG. 4A is a view of the opposite face of the card shown in FIG. 4.

As illustrated in FIGS. 2–2A, 3–3A and 4–4A, each card 34 in the deck 36 has on one face 38, as shown in FIGS. 2A, 3A and 4A, a figurative expression 40, a definition 42 of the figurative expression 40, and a number 44 for determining incremental advancement of the respective game piece along the continuous path 12 when a correct answer is given in a manner which will be explained later. Each of the respective cards 34 has a different figurative expression 40 and corresponding definition 42 thereon. Also the number 44 designating the incremental advancement may vary.

On the opposite face 46 of each card 34, shown in FIGS. 2–4, appears an illustration 48 which is symbolic of the figurative expression 40 on the card face 38. It is well known that the English language contains hundreds of figurative expressions that have acquired a particular meaning which differs substantially from a literal translation of the figurative expression. A group of words, used as an expression, which has its own meaning is an idiom. As well known standard dictionary information may provide the meaning of many idiomatic expressions, most initial knowledge of idiomatic expressions comes from an understanding of the language and associated culture. FIGS. 2–4 and the corresponding FIGS. 2A–4A are representative of the type of figurative expression that is used with the present invention. Thus the illustrations 48 and corresponding expressions 40 are only representative of the many figurative expressions used in the English language.

The figurative expression 40, shown in FIG. 2A, is "rat race" and is represented, as shown in FIG. 2 by the illustration 48 of a pair of rats running a race. Similarly, the figurative expression 40 of "nose to grindstone", as shown in FIG. 3A, is represented by the illustration 48 in FIG. 3 of one having his nose in contact with a rotating grinding stone. FIG. 4A illustrates the figurative expression 40 of "eat your words" which is symbolized in FIG. 4 by the illustration of a hand-held spoon and a bowl filled with words.

Thus, as seen in FIGS. 2–4 and FIGS. 2A–4A the figurative expression 40 and corresponding definition 42 are on one face of a card 34 and on the opposite face is shown the illustration 48 representing the expression where the illustration has a meaning symbolic of the expression. For purposes of example, some other combinations of illustrations and figurative expressions plus definitions are as follows:

| | |
|---|---|
| A Bookworm | |
| Definition | One who reads a lot of books |
| Illustration | A large worm, wearing glasses and mortarboard and holding a book |
| Work Out All The Bugs | |
| Definition | To solve the small problems |
| Illustration | Several bugs in sweatbands and work-out clothes doing exercises |

Referring to FIG. 1, there is illustrated on the game board 10 a number of combinations of figurative expressions and corresponding illustrations, such as the figurative expression 50 "raining cats and dogs" and the corresponding illustration 52; the figurative expression 54 "a piece of cake" and the corresponding illustration 56; the figurative expression 58 "contain yourself" and the corresponding illustration 60; and the figurative expression 62 "head in the clouds" and the corresponding illustration 64.

In accordance with the present invention, the game board 10 can be played at both a beginning level and at an advanced level. At the advanced level a first player presents to a second player one of the playing cards 34 in which the face 46 of the playing card bearing the illustration 48 is shown to the second player who must then interpret the illustration and announce the correct figurative expression 40 and as well, the correct definition 42 of the figurative expression 40. The answers must be given within a time period, as selected by the participants. In the event the answering player correctly identifies the figurative expression and gives the correct definition, then the player's game piece is advanced on the path 12 the number of increments 18 corresponding to the number 44 appearing on the card face 38.

If the answering player correctly announces the figurative expression 40 but incorrectly gives the definition 42, then the player may only advance one-half of the value of the number 44. For example, if the designated number is "4", then the player would only be permitted to advance two increments. If only two people are playing the game, then the card is placed in a discard pile.

If more than two participants are playing the game and the answering participant incorrectly defines the figurative expression, then the next answering participant is given the opportunity to give the definition of the figurative expression. If the third participant correctly defines the figurative expression, then that participant is given one-half the value of the number 44 appearing on the card to advance on the path 12. If the third player incorrectly defines the figurative expression, the correct definition is read aloud and then discarded. Of course, if the answering participant fails to correctly identity the figurative expression, then the next participant is given the opportunity to identify the figurative expression and give the definition.

If no participant can provide a correct answer to the figurative expression, then the expression and the definition are read aloud and the playing card is discarded. With this arrangement, not only must the participants deduce the figurative expression from the illustration, they must also correctly understand the meaning of the figurative expression which, of course, differs from the literal meaning. This adds to the challenge of the game and indicates in many instances that while participants recognize the figurative expression, the definition is not always clear.

In the above manner the players, in turn, are given the opportunity to provide answers and advance along the continuous path. During the advancement a player may find that he advances to an increment on the path that permits him to accelerate forward on the path or to move backward on the path. These increments are indicated by the directions "go ahead four spaces", "go ahead two spaces" and "go back three spaces". During the progress of the game, if the participant should settle on the increment 66 at the base of the short cut 20, then the participant may reduce the number of increments needed to advance to the finish point 16.

The present invention is also adaptable to be used by children, particularly of the grade school age, learning the English language and those unfamiliar with the English language. As discussed above in the use of the board game of the present invention by adults, the face of the playing card bearing the figurative expression and definition are concealed from the view of the answering participant. The answering participant only sees the illustration 48 of the card face 46.

In playing the board game with children, not only is the answering participant shows the illustration 48 but the correct figurative expression 40 is read to the answering participant. The answering participant must give the correct definition of the figurative expression 40 as symbolized by the illustration 48. By correctly defining the expressed figurative expression, the answering participant is allowed to advance on the continuous path 12 corresponding to the advancement number 44 appearing on the card face 38. If only two individuals are playing the game in this manner and the answering participant fails to give the correct definition, no advancement is permitted and the card is taken out of play. If the correct definition is given, then the next answering participant is presented with a new card from the deck holder.

Where more than two participants are involved, if the answering participant incorrectly gives a definition, then the next participant is given an opportunity to provide a correct definition. If the next answering participant correctly defines the expression incorrectly defined by the prior participant, then that answering participant may advance one-half the value of the advancement number 44 appearing on the card. If the answering participant fails also to give a correct definition, then the correct definition is read aloud for instructive purposes and then the card is taken out of play.

In view of the many figurative expressions that are adaptable for the present invention, categories of expressions can be arranged for the purpose of adapting the method of play to a television game show format. In this case the game is controlled by an emcee who directs a first contestant to choose a category, such as food, body parts, cars, articles of clothing, etc. from which a series of figurative expressions are illustrated. The contestant is then shown an illustration of a figurative expression which relates to the selected category. If the contestant should fail to provide the correct answer, then the contestant's opponent is given the opportunity to answer.

The invention in the television game show format also comprises a screen divided into increments and identified by categories. Upon correctly answering, the contestant is given a prize that is positioned behind the screen increment. The contestants may also be tested simultaneously in their ability to interpret a figurative expression from a literal illustration. Whichever one of two contestants is the first to ring a buzzer and identify the figurative expression from the illustration wins a prize. An incorrect answer by the first contestant permits the second contestant to identify the figurative expression. This form of playing the game of the present invention is also modified by exposing one or more words in an expression to a contestant and requiring the contestant to finish the expression without viewing an illustration of the expression. In this format a number of expressions are revealed in succession to determine the overall winner of the game.

Also, within the scope of the present invention, the game may be played in any number of languages where figurative expressions are selected that are commonly used with the language, for example, not only in English but in Spanish, French, German, etc. It is well known that other languages utilize expressions not found in the English language. Therefore, the figurative expressions are understood only in the context of the particular language and can be appropriately illustrated for use in the present invention. On the other hand, the present invention can be used to translate English figurative expressions to other languages for teaching idiomatic expressions commonly used in the United States.

According to the provisions of the patent statutes, I have explained the principle, preferred construction and mode of operation of my invention and have illustrated and described what I now consider to represent its best embodiments, however, it should be understood that, within the scope of the appended claims, the invention may be practiced otherwise than as specifically illustrated and described.

I claim:

1. A method for playing a game comprising the steps of, distributing to each participant a game piece for progressive incremental advancement along a course from a start point to a finish point on a game board, arranging a plurality of cards in a deck with each card having written on one face an idiomatic expression, a definition of the idiomatic expression as understood in the language of the expression and a number for determining incremental advancement along the course and on the opposite card face an illustration symbolic of the idiomatic expression, allowing each participant in turn to draw an individual card from the deck for providing an answer, concealing from the answering participant the face of the card bearing the idiomatic expression and exposing to the answering participant the opposite face of the card bearing the illustration symbolic of the idiomatic expression, requiring the answering participant to abstractly interpret the illustration on the opposite face of the card and translate the illustration into a known idiomatic expression, announcing aloud as the answer the idiomatic expression represented by the illustration, comparing the answer given by the answering participant with the idiomatic expression written on the one face of the card, rewarding the answering participant upon giving a correct answer by movement of the game piece of the answering participant a selected incremental advancement along the course, and designating as the winner of the game as the result of giving correct answers the first participant to incrementally advance along the course from the start point to the finish point.

2. A method as set forth in claim 1 which includes, announcing aloud as part of the answer the definition of the idiomatic expression as understood in the language symbolically represented by the illustration on the card.

3. A method as set forth in claim 1 which includes, varying the idiomatic expression and corresponding illustration from card to card in the deck.

4. A method as set forth in claim 1 which includes, arranging the cards in a plurality of decks where the subject matter of the idiomatic expressions on each card in a deck is related to a selected subject matter, and differing the subject matter of the idiomatic expression from one deck to another to provide a selected number of categories of subject matter arranged in card decks for playing the game.

5. A method as set forth in claim 1 which includes, submitting the card to a second answering participant to identify the idiomatic expression in the event the first answering participant incorrectly identifies the idiomatic expression.

6. A method as set forth in claim 5 which includes, rewarding the second answering participant upon correctly identifying the idiomatic expression by movement of the game piece of the second answering participant a selected incremental advancement along the course.

7. A method as set forth in claim 1 which includes, requiring the answering participant to maintain a fixed position on the course upon failure to correctly identify the idiomatic expression from an interpretation of the illustration.

8. A method as set forth in claim 1 which includes, submitting simultaneously the face of the card bearing the idiomatic expression to a first answering participant and a second answering participant, and rewarding the answering participant who is the first to correctly identify the idiomatic expression by movement of the game piece of said answering participant a selected incremental advancement along the course.

9. A method as set forth in claim 1 which includes, limiting the time the answering participant is given to provide an answer identifying the idiomatic expression illustrated on the face of the card.

10. A method for playing a game for teaching participants the meaning of idiomatic expressions comprising the steps of, distributing to each participant a game piece for progressive incremental advancement along a course from a start point to a finish point on a game board, arranging a plurality of cards in a deck with each card having written on one face an idiomatic expression, a definition of the idiomatic expression as understood in the language, and a number for determining incremental advancement along the course and on the opposite card face an illustration symbolic of the idiomatic expression, allowing each participant in turn to draw an individual card from the deck for providing an answer, concealing from the answering participant the face of the card bearing the idiomatic expression and exposing to the answering participant the opposite face of the card bearing the illustration symbolic of the idiomatic expression, reading to the answering participant the idiomatic expression as the answering participant views the illustration on the card, requiring the answering participant to abstractly interpret the illustration on the card in terms of the idiomatic expression, requiring the answering participant to define the meaning of the idiomatic expression based on the corresponding illustration, comparing the definition given by the answering participant with the definition of the idiomatic expression stated on the face of the card, rewarding the answering participant upon giving a correct answer by movement of the game piece of the answering participant a selected incremental advancement along the course, and designating as the winner of the game as the result of giving correct answers the first participant to incrementally advance along the course from the start point to the finish point.

11. A method as set forth in claim 10 which includes, submitting the card to a second answering participant to define the idiomatic expression in the event the first answering participant incorrectly defines the idiomatic expression.

12. A method as set forth in claim 11 which includes, rewarding the second answering participant for correctly defining the idiomatic expression by movement of the game piece of the second answering participant a designated number of increments along the course.

13. A method as set forth in claim 10 which includes, arranging the cards in categories of related subject matter for the idiomatic expressions, permitting the answering participant to select a category of idiomatic expressions, and drawing at random a card from the selected category for presentation to the answering participant.

* * * * *